United States Patent [19]

Black

[11] Patent Number: 4,693,212

[45] Date of Patent: Sep. 15, 1987

[54] ANIMAL RESTRAINT APPARATUS AND METHOD

[76] Inventor: Kenneth R. Black, P.O. Box 2073, Universal City, Tex. 78148

[21] Appl. No.: 825,346

[22] Filed: Feb. 3, 1986

[51] Int. Cl.[4] ..... A61D 3/00

[52] U.S. Cl. ..... 119/103

[58] Field of Search ..... 119/96, 103, 126, 128; 128/134, 135; 54/72

[56] References Cited

U.S. PATENT DOCUMENTS

| | | | |
|---|---|---|---|
| 886,656 | 5/1908 | Smith | 119/103 |
| 3,215,834 | 11/1965 | Tayman | 119/103 |
| 4,184,451 | 1/1980 | Carlin | 119/103 |
| 4,261,296 | 4/1981 | Rosenberg | 119/103 |

*Primary Examiner*—Robert P. Swiatek

*Attorney, Agent, or Firm*—Charles P. Padgett, Jr.

[57] ABSTRACT

An animal restraint apparatus having a plurality of elongate anchoring members each of which is attached to a baseboard by means of elongated pin which is received within an elongate slot in each elongate anchoring member. Each pin is provided with threads onto which a wing nut is threaded, the wing nuts being capable of firmly securing each elongate anchoring member in a selected position on the baseboard. Each elongate member is provided with a first strap to encircle an ankle of the animal to be restrained on the apparatus and a second strap for attaching the first strap to one end portion of the elongate anchoring members.

15 Claims, 8 Drawing Figures

ANIMAL RESTRAINT APPARATUS AND METHOD

BACKGROUND OF THE INVENTION

The present invention relates to an animal restraint apparatus. More particularly, it relates to an apparatus for holding the feet of an animal which is extremely adaptable for use with animals of varying sizes. The apparatus is comfortable and safe for the animals when in use and is simple to use.

The animal restraint apparatus of the present invention can be used to advantage for washing and grooming animals, or to administer medication or treatment to an animal. Other devices are known which are directed to the same object, but these devices are characterized by certain disadvantages which limit their utility. In particular, U.S. Pat. No. 4,186,690 discloses an animal grooming tethering device consisting of a leash attached to an overhead rod mounted on a grooming table. The device restrains the animal by the neck, permitting free movement of the animal's legs and body. A safety breakaway clip prevents strangulation or injury to an animal if it should jump or fall from the grooming table. An animal restrained in such a tether system continuously attempts to free itself by jumping, scratching and other agitated movements. Consequently, it is difficult to groom the animal or provide the necessary care.

Prior to the present invention, the idea of restraining the feet of an animal for grooming or other care was disclosed in U.S. Pat. Nos. 1,109,772, 2,832,313, and 3,484,096. Pat. No. 1,109,772 discloses a chicken-holding device having foot clamps in a fixed position and a saddle upon which the chicken's body is placed. The combination of the saddle and foot clamps maintains the chicken in an upright position for grooming. The only adjustable component of the device is the height of the saddle. The device is only useful for supporting a chicken for grooming, and would be both uncomfortable and impractical for use with other types of animals.

U.S. Pat. Nos. 2,832,313 and 3,484,096 disclose systems for holding small laboratory animals for surgery on an anesthetized animal or for dissection. Both disclose means for grasping the feet of an animal. U.S. Pat. No. 2,832,313 discloses hooks attached to key chains which can be slid around the perimeter of a dissecting tray for adjustment. This device is useful only for dissecting or surgery on anesthetized small animals because an unanesthetized or larger animal can easily escape from the securing hooks or cause the key-chain fastener to slide around the perimeter of the tray. U.S. Pat. No. 3,484,096 discloses elastic cords affixed to "Velcro"-type fasteners which can be positioned on a Velcro fabric covered dissecting board at selected points as needed for dissection. The apparatus of U.S. Pat. No. 3,484,096 is useful only for dissection, and could not receive a large standing animal on its domed base board.

The present invention represents an improved apparatus over the prior art. It is characterized by a number of advantages which increase its utility over prior art devices, including its (1) ability to hold animals of various sizes, (2) ability to hold animals having two, three or four feet, and (3) ability to provide comfort, safety, and ease of use for both the animal and the caretaker.

It is, therefore, an object of the present invention to provide an animal restraint apparatus for securely holding the feet of an animal while the animal is in an upright, standing position for grooming or other needs, comprising a base board, a plurality of elongate anchoring members, each of the elongate anchoring membes having a longitudinal slot therein receiving a pivot pin which can be positioned on the baseboard by tightenting a wing nut threaded onto each pivot pin, each elongate anchoring member being provided with means for releasably restraining each foot of the animal restrained on the apparatus.

A further object of the present invention is to provide a method for restraining an animal which is being groomed or otherwise cared for.

It is a further object of the present invention to provide a restraint system which is comfortable for the animal, calming in effect, and safe for the animal being restrained.

Another object of the present invention is to provide a system which can be quickly adjusted to a particular size of animal, quickly adjusted to the animal's feet, and quickly and easily released from the animal's feet.

It is yet a further object of the present invention to provide a restraint system for securely positioning a dog in an upright standing position for grooming, administering medical care, and the like.

A further object of the present invention is to provide an animal grooming or care system which is inexpensive to produce and simple to use on substantially any pet or by any large domestic animal owner or caretaker thereof.

Other objects and advantages will be apparent to those of skill in the art who have the benefit of the following disclosure.

SUMMARY OF THE INVENTION

These objects and advantages are accomplished by providing an animal restraint apparatus for securely holding the feet of an animal while the animal is in an upright, standing position for grooming or other needs comprising a base board, a plurality of elongate anchoring members, each elongate anchoring member having a longitudinally extending slot therein. A plurality of pivot pins or externally threaded posts are mounted on the base board, each pivot pin being received within the slot of an elongate anchoring member, permitting each elongate anchoring member to be pivoted, slided, rotated, and otherwise positioned about the pivot pins, and then secured in a selected position relative to each of the pivot pins with means for securing each elongate member which is mounted on each pivot pin. Means is attached to the end of each of the elongate anchoring members to restrain each foot of the animal.

DETAILED DESCRIPTION OF THE PREFERRED EMBODIMENT

Figure 1:
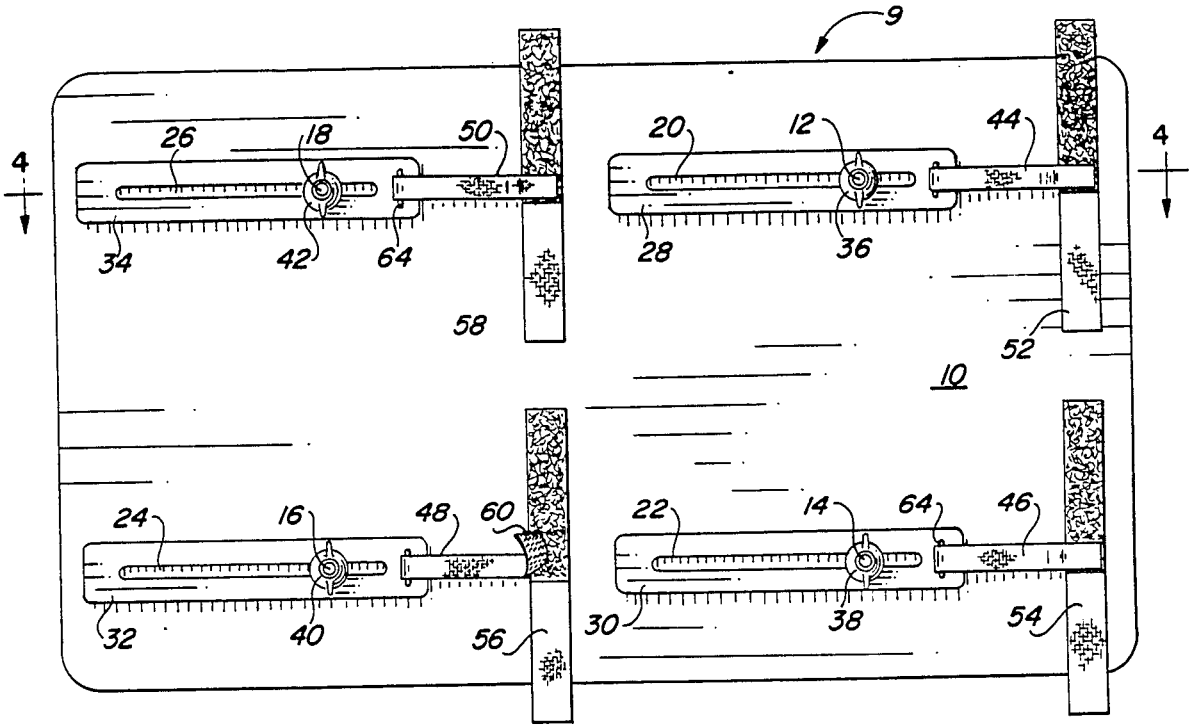
FIG. 1 is a top plan view of the animal restraining apparatus of the present invention.
Figure 2:
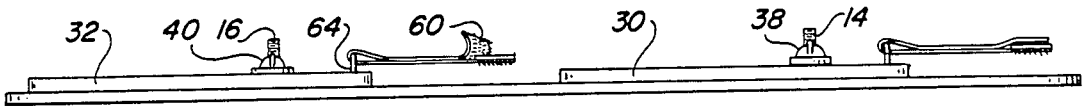
FIG. 2 is a side view of the apparatus of FIG. 1.
Figure 3:
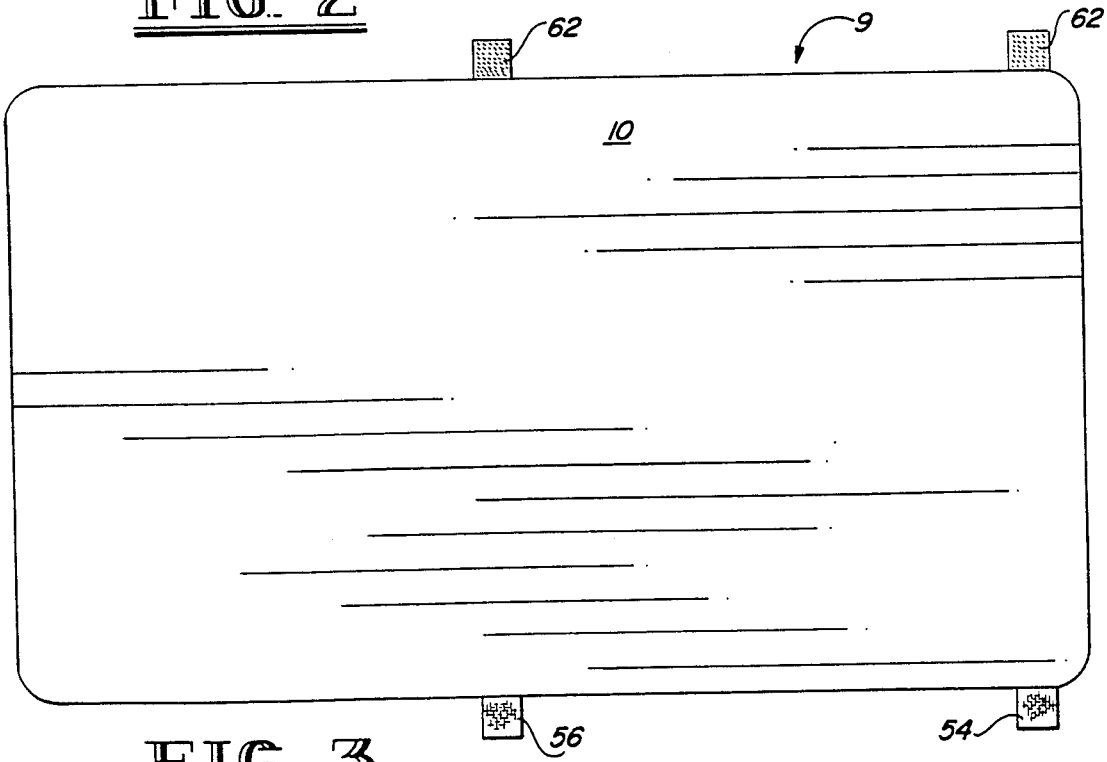
FIG. 3 is a bottom view of the apparatus of FIG. 1.
Figure 4:
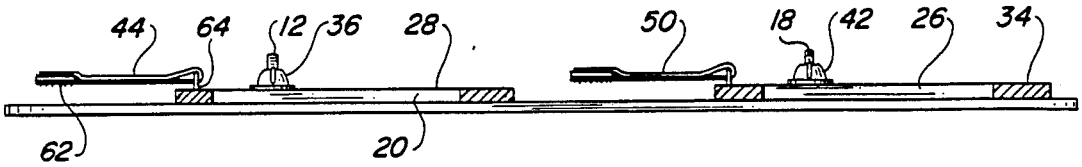
FIG. 4 is a cross-sectional side view of the apparatus of FIG. 1 taken along the view lines 4—4 on FIG. 1.
Figure 5:
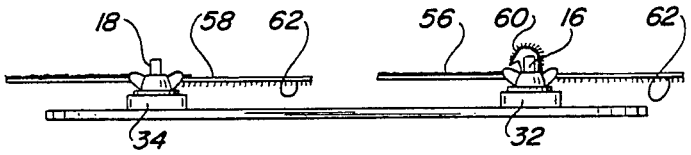
FIG. 5 is an end view of the apparatus of FIG. 1.
Figure 7:
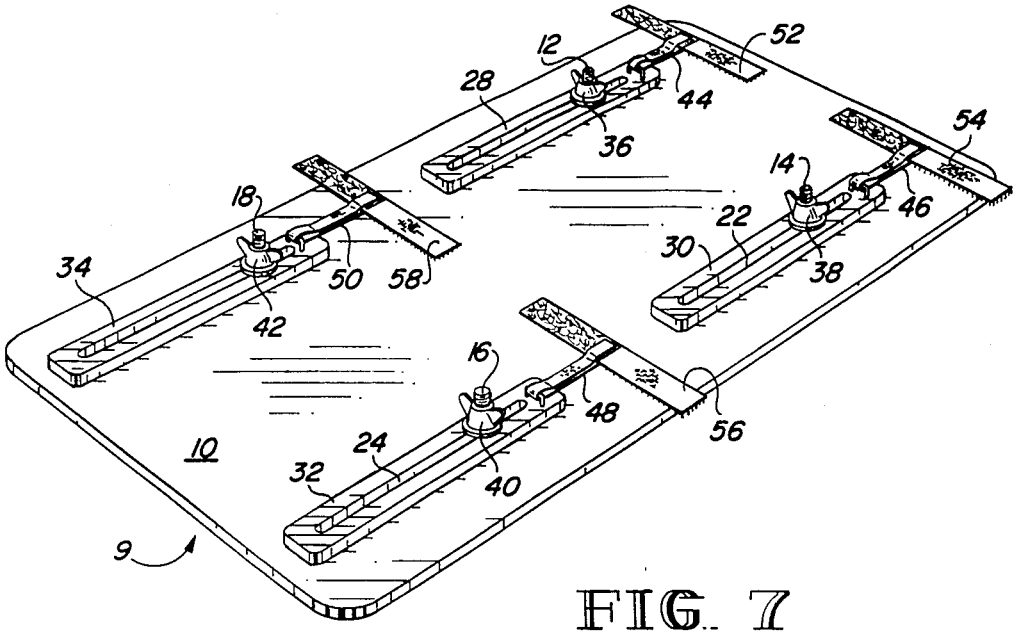
FIG. 7 is a perspective view of the apparatus of FIG. 1.
Figure 8:
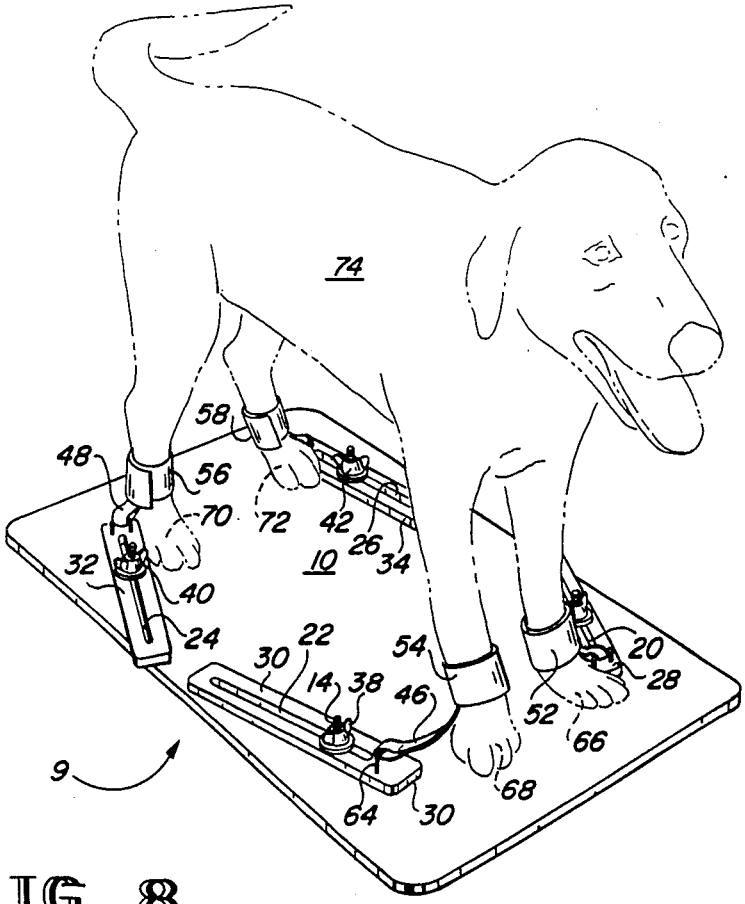
FIG. 8 is a perspective view of the apparatus of the present invention showing an animal restrained thereon.

Referring to FIGS. 1, 7 and 8, there is shown an apparatus constructed according to the teachings of the present invention designated generally by reference numeral 9. The apparatus 9 is comprised of a generally flat, rectangular base board 10, having a plurality of pivot pins, externally threaded posts or bolt shafts 12, 14, 16 and 18 mounted thereon. Each of the pivot pins 12–18 is received within the longitudinal slot 20, 22, 24 and 26 (see FIGS. 1 and 4) of a respective elongate anchoring member 28, 30, 32 and 34. Means is provided on each pivot pin 12–18 for securing each of the elongate anchoring members 28–34 in a selected position relative to the pivot pins 12–18 in the form of a wing nut 36, 38, 40 and 42 threaded onto each of the pivot pins 12–18.

Figure 6:
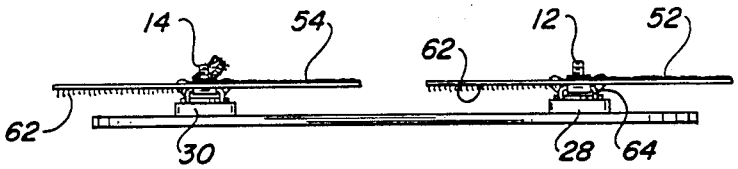
FIG. 6 is an end view of the apparatus of FIG. 1 from the opposite end of the view of FIG. 5.

Each of the elongate members 28–34 is provided with means for restraining each foot of the animal to be restrained on the apparatus 9 in the form of a first strap 44, 46, 48 and 50 (See FIG. 7) which is releasably attached to the elongate anchoring members 28–34 proximate one end portion thereof and to the second strap 52, 54, 56 and 58 proximate the other end portion thereof. In a presently preferred embodiment, both the first straps 44–50 and second straps 52–58 are comprised of "VELCRO" material and are provided with a strip of VELCRO hook and loop fasteners 60 and 62, respectively at the ends thereof (see FIGS. 2, 3, 5 and 6). The second straps 52–58 are comprised of "VELCRO" material with the strip of hooked fasteners 62 on the ends thereof so as to be quickly and easily adjusted to the diameter or thickness of the foot of the animal to be restrained on the apparatus 9. First straps 44–50 are attached to the elongate anchoring members 28–34 by looping each strap 44, 46, 48 or 50 through bracket 64 mounted on each elongate anchoring member 28–34 (see FIGS. 6 and 8).

The use of the apparatus 9 of the present invention is shown in FIG. 8 as follows. The wing nuts 36–42 are loosened sufficiently to permit the elongate anchoring members 28–34 to slide and pivot or rotate about the pivot pins, or externally threaded pins or posts, thereby permitting the positioning of the elongate anchoring members 28–34 to a selected position relative to the elongaged pins 12–18. This feature is of particular advantage for use in grooming or medical care of animals of varying sizes. Each wing nut 36–42 is then tightened against its respective elongate anchoring member 28–34, securing or clamping that elongate anchoring member 28–34 in place on the generally flat, rectangular base. The second straps 52–58 are then wrapped around each respective foot 66, 68, 70 and 72 of the four-legged animal 74 and secured by pressing the Velcro hook and loop fasteners 52, 54, or 56; and 62, respectively, against each respective strap 52–58. The first straps 44–50 are then used for final positioning of the animal 74 on the base. Each respective strap 44–50 is pulled through bracket 64, doubling it back upon itself until the proper length is reached and the Velcro hook and loop fasteners 60 are then pressed against each other to secure the straps 44, 46, 48, and 50.

In FIGS. 1, 7, and 8, it will be observed that each of the generally rectangular slotted anchoring members 28, 30, 32 and 34 is positioned such that the respective slots 20, 22, 24, and 26, are operatively disposed over a corresponding externally threaded member 12, 14, 16, and 18, respectively, for enabling the anchoring members 28, 30, 32, and 34 to reciprocably slide and rotate about the elongated pins 12, 14, 16, and 18. This enables the anchoring members 28, 30, 32, and 34 to be selectively and adjustably positioned at any number of locations on the base board pin, and preferably, to be arranged, positioned, or located at an optimal position for the particular animal to be restrained by the present system. Wing nuts 36, 38, 40 and 42 can be used to operatively engage the external threads of the pins 12, 14, 16, and 18 to securely clamp the elongate anchoring members 28, 30, 32, and 34 securely against the support or base board 10 to prevent subsequent movement of the anchoring members 28, 30, 32, and 34 once the wing nuts are securely fastened onto the threaded posts or pins 12, 14, 16, and 18. One end portion, usually the outermost end portion, of each of the elongate anchoring members 28, 30, 32, and 34 is attached to one end of the first straps 44, 46, 48, and 50 while the opposite end of the first straps 44, 46, 48, and 50 are secured to a central portion of a corresponding second set of straps 52, 54, 56, and 58, respectively, such that the opposite sides of the opposite end portions of the second straps 52, 54, 56, and 58 are provided with corresponding hook and loop fastener means so that the second straps 52, 54, 56, and 58 can be adjustably and removably secured by wrapping them around various thicknesses or diameters of the legs or ankles of the animals to be secured thereby. Once the elongate anchoring members are secured to the boards, the second straps are secured wrapped around the animal's ankles, and the first straps are adjusted for length and then fastened to secure the first straps to the previously secured elongate anchoring members, the animal being restrained against any further movement so as to enable or facilitate grooming, administering medical assistance, or the like to the restrained animal without, in any manner, injuring or discomforting the animal being restrained.

Although the present invention has been described in terms of the foregoing preferred embodiment, this description has been provided by way of explanation only and is not to be construed as a limitation on the invention, the scope of which is limited only by the following claims.

What is claimed is:

1. An animal restraint apparatus for securely holding the ankle portion of an animal while the animal is in an upright, standing position for grooming, administering medical care, or for tending to other needs comprising:

a relatively flat, planar base board means for supporting the entire weight of the animal to be restrained thereon, said board means being adapted to support the feet of the animal to be restrained thereon when said animal is in said upright standing position;

a plurality of elongate anchoring members, each of said elongate anchoring members having a centrally disposed, longitudinally extending slot therein, each of said anchoring members having a longitudinal axis disposed substantially parallel to the plane of said base board;

a plurality of elongated pins operatively mounted on said base board, each of said elongated pins having an axis which is disposed generally perpendicular to the plane of said base board, each of said elongated pins being operatively and slideably received within a corresponding slot of each of said elongate anchoring members whereby each of said elongate anchoring members can be rotated and reciprocally, slideably positioned in selected longitudinal locations relative to each of the corresponding pins;

means for releasably and clampably securing each of said elongate anchoring members in said selected location on said base board; and means attached to one of the ends of each of said elongate anchoring members for removably restraining each foot of the animal to be restrained such that said animal is restrained in an upright standing position on said base board with its legs generally normal to the plane thereof.

2. The animal restraint apparatus of claim 1 wherein said foot restraining means includes, for each of said elongate anchoring members, first and second straplike means (1) said first strap-like means attaching one end portion of each of said elongate anchoring members to a corresponding one of said second strap-like means for interconnecting same.

3. The animal restraint apparatus of claim 2 wherein each of said second strap-like means includes an elongated second flexible strap having adjustable fastening means on the opposite ends thereof for wrapping each of said second straps around one of the ankles of the animal to be restrained for securing and preventing movement of the corresponding animal, and wherein each of said first strap-like means includes an elongated first flexible strap having fastening means operatively disposed on both ends thereof, one of the ends of said first elongated strap including fastening means for operatively securing same to one end of said elongate anchoring members and the opposite end of said first elongated strap including fastening means for operatively securing said second strap thereto.

4. The animal restraint apparatus of claim 3 wherein the opposite end portion of each said first strap is secured to a central portion of each said second strap such that the axis of the second strap is substantially perpendicular to the axis of the first strap and the axis of each first strap is substantially parallel to and coaxial with the axis of its associated elongate anchoring member.

5. The animal restraining apparatus of claim 1 wherein each of said elongated pins is provided with external threads, said threads being operatively engaged by a nut-like means of said elongate anchoring member securing means.

6. The animal restraint apparatus of claim 1 wherein the animal under restraint has at least two legs.

7. The animal restraint apparatus of claim 6 wherein the animal under restraint has four legs.

8. The animal restraint apparatus of claim 1 wherein said animal under restraint is a mid-sized animal such as a domestic dog.

9. The animal restraint apparatus of claim 1 wherein said animal to be restrained is a domesticated dog.

10. A method of physically restraining the feet of an animal while the animal is in an upright, standing position for grooming or other needs comprising the steps of:

adjusting a plurality of elongate anchoring members slideably and rotatably mounted upon a horizontally disposed base board and each having means at one end for restraining each foot of an animal to a selected position approximating the normal stance of an animal such that the legs of the standing animal are substantially perpendicular to the plane of the base board upon which the animal is standing;

adjustably and releasably securing the elongate anchoring members to the base board in said selected position;

positioning the feet of the animal on the base board in close proximity to the end of the elongate anchoring members having the foot restraining means thereon, said base board means supporting the entire weight of the animal standing upright thereon; and securing each of the foot restraining means around each respective ankle portion of the lower leg of the animal.

11. The method of claim 10 additionally comprising the step of selectively adjusting the fit of each of the foot restraining means as it is wrapped around the ankle portion of said animal under restraint.

12. A restraint system for positioning an animal such as a dog in an upright, standing position for grooming, administering medical aid, or the like, said restraint system comprising:

a relatively flat, planar, base support member adapted to be disposed in a generally horizontal plane for receiving the feet of the animal to be restrained thereon when said animal is in an upright position and for supporting the entire weight of said animal during restraint;

four elongated anchoring members each having a first end portion, an opposite end portion, and a longitudinal slot therethrough, said slot extending a major portion of the distance between said end portions and having a longitudinal axis adapted to be operatively disposed in parallel with the planar surface of said base support member;

four elongated members operatively disposed in a generally rectangular configuration on the planar surface of said base support member and generally having their longitudinal axes disposed substantially perpendicular to the plane of said base member;

said elongated slots of each of said elongated anchoring members being adapted to be operatively received over a corresponding one of each of said elongated members for reciprocal, slideable, longitudinal movement and rotational movement thereon;

means for adjustably, operatively positioning each of said elongated anchoring members in an optimum position for the particular animal to be restrained and means for clampably securing said optimally positioned anchoring members to said base member at said optimal position;

first elongated, flexible strap means adapted to be selectively and removably wrapped around the ankle portion of each leg of the animal being restrained so as to be secured therebout, each said first strap means being substantially flat and having a longitudinal axis; and second elongated flexible strap means adapted to be adjustably and removably secured between one end of each of said anchoring members and a mid-portion of each said first strap means for adjustably attaching same, the axis of each said second strap means being substantially perpendicular to the axis of each said first strap means and being generally parallel to an coaxial with the elongated axis of the elongated slot of the corresponding anchoring member.

13. The restraint system of claim 12 wherein said first flexible strap means includes hook and loop fastener means operatively disposed on opposite sides of the opposite ends thereof for enabling said opposite end portions to be fastened together at adjustable positions for accommodating various diameter ankles of animals to be restrained.

14. The restraint system of claim 13 wherein said second strap means includes fastener means operatively disposed on opposite ends thereof and each of said fastener means at each of the ends of said second elongated strap means including both a hook and a loop fastener portion, one on each side thereof, for enabling one end thereof to be adjustably attached to said one end of a corresponding anchoring member and the opposite end thereof to be adjustably and removably secured to the mid-portion of a said first flexible strap means.

15. The restraint system of claim 12 wherein said base support member includes a substantially flat, generally rectangular platform adapted to be operatively disposed horizontally for enabling the animal to be restrained to stand upright with the longitudinal axes of its legs being disposed generally perpendicular to the plane of said base member, the plane of said base support member being fixedly positioned once said animal to be restrained is positioned and secured thereon.

* * * * *